United States Patent [19]

Takayama et al.

[11] 4,264,698

[45] * Apr. 28, 1981

[54] DEVELOPER FOR ELECTROSTATIC PHOTOGRAPHY AND PROCESS FOR PREPARATION THEREOF

[75] Inventors: Hiroshi Takayama, Moriguchi; Tatsuo Aizawa, Osaka, both of Japan

[73] Assignee: Mita Industrial Company Limited, Osaka, Japan

[ * ] Notice: The portion of the term of this patent subsequent to Apr. 4, 1995, has been disclaimed.

[21] Appl. No.: 732,759

[22] Filed: Oct. 15, 1976

[30] Foreign Application Priority Data

Oct. 27, 1975 [JP] Japan ..... 50/128313

[51] Int. Cl.[3] ..... G03G 9/08; G03G 9/14

[52] U.S. Cl. ..... 430/109; 252/62.54; 252/62.55; 252/511; 252/512; 252/514; 427/222; 428/407; 430/110; 430/111

[58] Field of Search ..... 252/62.1 P, 62.53, 62.54, 252/62.55, 500, 511, 512, 514; 430/107–111; 427/18, 222; 428/402, 407

[56] References Cited

U.S. PATENT DOCUMENTS

| | | | |
|---|---|---|---|
| 3,196,032 | 7/1965 | Seymour | 252/62.1 P X |
| 3,345,294 | 10/1967 | Cooper | 252/62.1 P |
| 3,627,682 | 12/1971 | Hall, Jr. | 252/62.1 P |
| 3,639,245 | 2/1972 | Nelson | 252/62.1 P |
| 3,925,219 | 12/1975 | Strong | 252/62.1 P |
| 4,082,681 | 4/1978 | Takayama et al. | 252/62.1 P |

*Primary Examiner*—Bruce H. Hess

*Attorney, Agent, or Firm*—Sherman & Shalloway

[57] ABSTRACT

A developer for electrostatic photography consisting essentially of a dry blend of (A) substantially spherical fixing magneto-sensitive particles of a composition comprising a binder medium and a fine powder of a magnetic material dispersed in the binder medium, the substantially spherical particles (A) have on their surfaces fine convexities and concavities formed by spraying a dispersion of the composition into a drying atmosphere and have a particle size of 2 to 44 microns, and (B) flowability- and electric resistance-controlling fine particles having a volume resistivity not higher than $10^{12}$ $\omega$-cm and a particle size not larger than 1/10 of the particle size of the substantially spherical particles (A). The fine particles (B) are distributed predominantly on the surface portion of said spherical particles (A). The mixing weight ratio of (A):(B) is in the range of from 1000:1 to 50:1.

6 Claims, No Drawings

DEVELOPER FOR ELECTROSTATIC PHOTOGRAPHY AND PROCESS FOR PREPARATION THEREOF

This invention relates to a developer for electrostatic photography and a process for the preparation thereof. More particularly, the invention relates to a developer for electrostatic photography which consists essentially of a dry blend of specific fixing magneto-sensitive particles and flowability- and electric resistance-controlling fine particles and which has improved adaptability to the developing operation and excellent image-forming property, and to a process for the preparation of this developer for electrostatic photography.

A so-called magnetic brush method is broadly used as a method for developing electrostatic latent images formed by electrostatic photography. In early magnetic brush developing methods, particles of a developer (toner) comprising a pigment and a resin for imparting the fixing property and desirable electric characteristics to the pigment were mixed with a magnetic carrier such as iron powder, and the mixture was closely contacted with the surface of a support having a magnetic brush and carrying an electrostatic latent image to thereby visualize the latent image with the developer particles. According to this method using a mixture of the developer and magnetic carrier, however, only the developer particles in the mixture were consumed and the mixing ratio of the developer and magnetic carrier was changed in the mixture. Accordingly, the developer must often be supplied to the development mechanism to keep a prescribed balance between the developer and magnetic carrier. This is a very troublesome operation.

As toners capable of performing development without the aid of a particular carrier, there are known so-called magnetic toners such as disclosed in the specification of U.S. Pat. No. 3,639,245 and Japanese Patent Application Laid-Open Specification No. 20729/75. These magnetic toners are generally prepared by dispersing a powder of a magnetic material such as triiron tetroxide, if necessary with additives such as a pigment, into a medium of a binder resin and molding the dispersion into particles. In order to impart to these particles a property of being magnetically attractable as a whole and render the surfaces of the particles electrically conductive, an electrically conductive substance such as carbon black is embedded in the surfaces of the particles.

These magnetic toners have an advantage that clear toner images with a much reduced edge effect can be produced according to the magnetic brush development method without using a magnetic carrier or the like. However, production of these magnetic toners involves various difficulties. More specifically, the known process for the production of magnetic toners involves complicated steps of uniformly dispersing powder of a magnetic material, optionally with a pigment such as carbon black, into a melt of a binder resin medium, cooling and finely pulverizing the molten mixture and molding the pulverized mixture into fine particles under application of heat. Further, magnetic toner particles prepared according to this conventional process have a very broad particle size distribution range. When magnetic toners containing particles of a large particle size are employed, the resolving power is low in developed copies, and when magnetic toners containing particles of an extremely small particle size are employed, so-called fog is caused on development. Accordingly, in magnetic toners prepared according to the conventional process, the particle size should inevitably be adjusted by sieving or the like, resulting in reduction of yields of toners.

Moreover, the known magnetic toners are still insufficient in the flowability of the toner particles, and various problems are caused in connection with the developing operation by poor flowability of the toner particles. For example, the known magnetic toners do not have a flowability sufficient to distribute the toner particles uniformly on a developing roller (sleeve), and masses or agglomerates of the toner particles are often formed on the surface of the sleeve and they often fall on a copying sheet to contaminate the background of the obtained copy. Moreover, because of non-uniform adhesion of the toner particles on the surface of the sleeve, the resulting image is often blurred.

As means for improving the flowability in particles of magnetic toners, there is known a method in which finely divided silica is incorporated as a lubricant into particles of magnetic toners. However, since finely divided silica adhering to the peripheries of the toner particles has a relatively high electric resistance, the electric resistance of the developer as a whole is increased and therefore, such undesirable phenomena as bleeding of contours of the resulting image are readily caused to occur.

According to this invention, there is provided a developer for electrostatic photography, which is quite different from the above-mentioned known magnetic toners with respect to the microscopic structure and physical properties of the particles. More specifically, the developer of this invention consists essentially of a dry blend of (A) substantially spherical fixing magneto-sensitive particles composed of a composition comprising a binder medium and fine powder of magnetic material dispersed in the binder medium and (B) flowability- and electric resistance-controlling fine particles, the substantially spherical fixing magneto-sensitive particles (A) having on the surfaces thereof fine convexities and concavities formed by spraying a dispersion of the composition in a drying atmosphere, namely crater-like rough surfaces, such fine particles (B) being distributed predominantly on the surface portion of the spherical particles (A). By virtue of these characteristic features, the developer of this invention has in combination a good flowability of the developer particles suitable for the developing operation and a low electric resistance necessary for providing sharp images. More specifically, the developer of this invention has a flowability sufficient to distribute the developer particles uniformly on a developing sleeve, and hence, occurrence of such undesirable phenomena as contamination of the background by falling of masses of the developer particles and formation of blurred images by uneven adhesion of the developer particles can be effectively prevented.

Further, the developer of this invention has a low volume resistivity, ordinarily $1\times10^{12}$ Ω-cm or lower, especially $1\times10^{10}$ Ω-cm, irrespective of the humidity in the atmosphere. Because of this electric charactertistic, when the developer of this invention is used, a visible image having no bleeding in contours and a much reduced edge effect can be obtained.

According to this invention, such excellent flowability and low volume resistivity can be attained merely by dry-blending fixing magneto-sensitive particles (A) with flowability- and electric resistance-controlling fine particles such as particles of carbon black, and contamination of the background is not caused to occur when the so formed developer is used. This is quite surprising.

In magnetic toners prepared by merely dry-blending a magnetic material with carbon black, it is apprehended that at the step of forming electrostatic latent images, carbon particles separated from the magnetic toner will adhere to the background to degrade the clearness of formed copies. For this reason, in conventional magnetic toners, there is adopted a complicated operation of embedding carbon black in the surface portion of the magnetic toner. In contrast, in the present invention, even when the above-mentioned spherical particles are merely dry-blended with carbon black and the dry blend is applied to a photosensitive layer having an electrostatic latent image formed thereon, as is apparent from all the Examples given hereinafter, no contamination is caused on the background, the flowability of the developer is highly improved and bleeding of the toner image is remarkably reduced. We believe that attainment of this unexpected effect will be due to the fact that fixing magneto-sensitive particles (A) in the developer of this invention have the above-mentioned peculiar coarse surfaces full of tiny convexities and concavities and fine particles (B) such as of carbon black adhering to the spherical particles (A) are hardly disconnected from the spherical particles (A) at the development step and the fine particles (B) have activities of controlling the flowability and electric resistance of the spherical particles (A).

The developer for electrostatic photography according to this invention can easily be fixed on a copying paper by customary heat-fixing means, and it has a novel characteristic property that it can readily be fixed on a copying paper under a relatively low pressure. More specifically, since the spherical fixing magneto-sensitive particles in the developer of this invention have crater-like rough surfaces (confirmed by a layer oil absorption and from a microscopic photograph) formed by coagulating a magnetic material-binder medium dispersion in a drying atmosphere, the developer of this invention has a sufficient anchoring effect to a photosensitive layer or coating of a copying paper even under a relatively low pressure. Because of this characteristic property, it is readily embedded in the broken and ground state into the photosensitive layer or coating of a copying paper under application of a pressure at the fixing step and hence, a strongly fixed image is readily formed on the copying paper.

The substantially spherical fixing magneto-sensitive particles (A) of the developer of this invention can be prepared by spraying a dispersion of a fine powder of a magnetic material and a binder medium in an easily-volatile solvent in a drying atmosphere to thereby solidify (coagulate) the dispersion in the particulate form.

The fine powder of the magnetic material has preferably a particle size smaller than 100 mμ, especially preferably a particle size smaller than 500 mμ.

As inorganic magnetic materials heretofore used in this field, there can be mentioned, for example, triiron tetroxide ($Fe_3O_4$), diiron trioxide ($\gamma$-$Fe_2O_3$), zinc iron oxide ($ZnFe_2O_4$), ytterium iron oxide ($Y_3Fe_5O_{12}$), cadmium iron oxide ($CdFe_2O_4$), copper iron oxide ($CuFe_2O_4$), lead iron oxide ($PbFe_{12}O_{19}$), nickel iron oxide ($NiFe_2O_4$), neodium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni) and the like. In this invention, at least one member selected from the foregoing magnetic materials is used, and use of triiron tetroxide as the magnetic material is especially preferred for attaining the intended objects of this invention.

Any of natural, semi-synthetic and synthetic resins and rubbers having a suitable adhesiveness under application of heat or pressure can be used as the resin binder in combination with the above-mentioned magnetic material. These resins may be thermoplastic resins, or uncured theremosetting resins or precondensates thereof. As valuable natural resins, there can be mentioned, for example, balsam, rosin, shellac, copal and the like. These natural resins may be modified with one or more of vinyl resins, acrylic resins, alkyd resins, phenolic resins, epoxy resins and oleoresins (oil resins) such as mentioned below. As the synthetic resin that can be used in the present invention, there can be mentioned, for example, vinyl resins such as vinyl chloride resins, vinylidene chloride resins, vinyl acetate resins and vinyl acetal resins, e.g., polyvinyl acetal; acrylic resins such as polyacrylic acid esters, polymethacrylic acid esters, acrylic acid copolymers and methacrylic acid copolymers; olefin resins such as polyethylene, polypropylene, polystyrene and styrene copolymers; polyamide resins such as nylon-12, nylon-6 and polymeric fatty acid-modified polyamides; polyesters such as polyethylene terephthalate/isophthalate and polytetramethylene terephthalate/isophthalate; alkyd resins such as phthalic acid resins and maleic acid resins; phenolformaldehyde resins; ketone resins; coumarone-indene resins; amino resins such as urea-formaldehyde resins and melamine-formaldehyde resins; and epoxy resins. These synthetic resins may be used in the form of mixtures, for example, a mixture of a phenolic resin and an epoxy resin and a mixture of an amino resin and an epoxy resin.

As the natural and synthetic rubbers that can be used in the present invention, there can be mentioned, for example, natural rubber, chlorinated rubber, cyclized rubber, polyisobutylene, ethylene-propylene rubber (EPR), ethylene-propylene-diene rubber (EPDM), polybutadiene, butyl-rubber, styrene-butadiene rubber (SBR), acrylonitrile-butadiene rubber and the like.

In this invention, the binder resin medium and finely divided powder of a magnetic material can be mixed at various ratios, but in order to obtain a developer capable of attaining the foregoing objects, it is important that the finely divided magnetic material should be incorporated at such a ratio that the finely divided magnetic material is present in the resulting developer in an amount of 20 to 80% by weight, especially 40 to 60% by weight, based on the spherical particles (A). In the cases where the amount of the finely divided magnetic material is smaller than 20% by weight, it is difficult to impart sufficiently to the spherical particles (A) the above-mentioned property of being magnetically attractable. When the amount of the finely divided magnetic material exceeds 80% by weight, the form-retaining property is often degraded in the resulting spherical particles (A).

In order to improve the color or hue of the spherical particles (A) and to extend the spherical particles (A), various dyes, pigments and extender pigments may be incorporated in the present invention. Suitable examples of these dyes, pigments and extender pigments are as follows:

Black Pigments

Carbon black, acetylene black, lamp black and Aniline Black

Yellow Pigments

Chrome yellow, zinc yellow, cadmium yellow, yellow iron oxide, Mineral Fast Yellow, nickel titanium yellow, Nablus Yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake Orange Pigments Chrome orange, molybdenum orange, Permanent Orange GTR, Pyrazolone Orange, Balkan Orange, Indanthrene Brilliant Orange RK, Benzidine Orange G and Indanthrene Brilliant Orange GK Red Pigments Red iron oxide, cadmium red, red lead, cadmium mercury sulfide, Permanent Red 4R, Lithol Red, Pyrazolone Red, Watchung Red Calcium salt, Lake Red D, Brilliant Carmine 6B, Eosine Lake, Rhodamine Lake B, Alizarine Lake and Brilliant Carmine 3B Violet Pigments Manganese violet, Fast Violet B and Methyl Violet Lake Blue Pigments Ultramarine, cobalt blue, Alkali Blue Lake, Victoria Blue Lake, Phthalocyanine Blue, metal-free Phthalocyanine Blue, partially chlorinated Phthalocyanine Blue, Fast Sky Blue and Induthrene Blue BC Green Pigments Chrome Green, chromium oxide, Pigment Green B, Malachite Green Lake and Fanal Yellow Green G White Pigments:

Zinc flower, titanium oxide, antimony white and zinc sulfide

Extender Pigments

Baryte powder, barium carbonate, clay, silica, white carbon, talc and alumina white Dyes (basic, acidic, disperse and direct dyes)

Nigrosine, Methylene Blue, Rose Bengale, Quinoline Yellow and Ultramarine Blue

It is preferred that these pigments and extender pigments have a particle size equal to or smaller than the size of the finely divided magnetic material, and that they be used in an amount smaller than 50% by weight, especially smaller than 10% by weight, based on the final composition.

In this invention, it is preferred that the substantially spherical fixing magneto-sensitive particles be composed of 40 to 60% by weight of a finely divided magnetic material, 30 to 60% by weight of a binder medium such as a resin, a rubber or a wax and 1 to 10% by weight of carbon black.

As the easily-volatile solvent for dispersing the finely divided magnetic material and binder medium, there can be used any of solvents capable of dissolving therein the binder medium and volatilizing in a drying atmosphere. For example, there can be mentioned lower alcohols such as methanol, ethanol, propanol and various cellosolves, ketones such as acetone and methylethyl ketone, ethers such as tetrahydrofuran and dioxane, amides such as N,N-dimethylformamide and N,N-dimethylacetamide, amines such as morpholine and pyrrolidone, sulfoxides such as dimethylsulfoxide, aromatic hydrocarbon solvents such as benzene, toluene and xylene, halogenated hydrocarbon solvents such as chloroform, carbon tetrachloride, trichlene, perchlene and freon, esters such as ethyl acetate and amyl acetate, and other organic solvents. These solvents may be used singly or in the form of a mixture of two or more of them. Suitable kinds of solvents are chosen depending on the kinds of the binder media used.

In order to form fine convexities and concavities on the surfaces of the spherical particles, it is very effective to cause prompt evaporation of the organic solvent at the spray drying granulation step. When a resin such as an epoxy resin is used as the binder medium, it is preferred to use an easily volatile organic solvent having a boiling point lower than 90° C. and a vapor pressure higher than 100 mm Hg at 20° C., such as actone. When a wax is used as a binder medium, in view of the dissolving power it is necessary to use an aromatic organic solvent such as hot toluene. In this case, it is preferred to heat a spraying liquid in advance and increase the temperature of the drying atmosphere to a considerably high level, for example, 150° C., to cause prompt evaporation of the solvent.

The solid concentration in the dispersion is chosen so that the dispersion can be sprayed and can easily be solidified (coagulated) in spherical particles in a drying atmosphere. In general, the solid concentration of the dispersion is in the range of from 20 to 80% by weight, preferably in the range of 40 to 60% by weight. It is especially preferred that the resin concentration be in the range of 5 to 30% by weight, especially 8 to 20% by weight.

This spraying dispersion can readily be prepared by mixing a solution or dispersion of the binder medium in a solvent such as mentioned below with the above-mentioned amount of a powder of a magnetic material by known dispersing means such as ultrasonic vibration, homogenizing or ball milling. The so prepared dispersion is sprayed in a drying atmosphere to effect granulation.

In this invention, as the drying atmosphere there are employed various gases, such as air, nitrogen, carbon dioxide gas and combustion gas, heated at 5° to 200° C., especially gases heated at a temperature higher than the boiling point of the solvent used. A dispersion of the fine powder of the magnetic material and the binder medium is sprayed into such drying atmosphere. At this spraying step, the high temperature gas current acts as a dispersion medium and the sprayed dispersion is present in the gas current in the form of spherical particles. In this state, the solvent is evaporated into the high temperature gas current. Evaporation of the solvent first advances in the surface portions of the sprayed spherical particles, and as the solvent in the interiors of the particles volatilizes, the volumes of the particles are contracted or pores are formed on and in the particles by evaporation of the solvent. As a result, fine convexities and concavities are formed on the surfaces of the particles. In order to form such fine convexities and concavities effectively on the surfaces of the particles, it is important that the binder medium concentration in the dispersion to be sprayed should be not higher than 30%.

The particle size of the so formed spherical particles is changed depending on such factors as the solid concentration and viscosity of the dispersion to be sprayed, the speed of spraying the dispersion and the temperature and velocity of the drying atmosphere. In this invention, it is preferred that these conditions be set so that the resulting spherical particles have an average particles size of 1 to 100 microns, especially 2 to 50 microns, and they have such a particle size distribution that particles having a particle size larger than 44μ occupy up to 10% of the total particles and particles having a particle size smaller than 2μ occupy up to 10% of the total particles.

Various known means may be adopted for spraying the dispersion of a fine powder of a magnetic material and a binder medium. For example, there can be used a one-fluid or two-fluid nozzle, a centrifugal spray nozzle comprising a rotary member having a number of holes formed on the circumferential wall thereof, a rotary disc and the like. The so obtained fixing magneto-sensitive particles (A) are, if desired, dried under reduced or atmospheric pressure under such conditions such that substantial fusion of the binder medium is not caused, whereby the remaining solvent can be removed from the particles. Then, the particles (A) are used for production of the developer of this invention.

Since the fixing magneto-sensitive particles (A) that are used in this invention have on the surfaces thereof fine convexities and concavities, namely crater-like rough surfaces, they have an oil absorption of 25 to 40, especially 28 to 35.

The oil absorption referred to in the instant specification is one determined according to JIS K-5101 in the following manner:

A sample (10 g) is charged in a beaker, and purified linseed oil is gradually added dropwise to the sample. Every time a prescribed amount of linseed oil is added, the mixture is kneaded by a glass rod. This dropping and kneading operation is continued until the mixture is drawn upwardly in a rod-like form when the kneading rod is lifted up from the mixture and linseed oil is in the state oozing out on the surface of the rod-like mixture. The oil absorption is calculated according to the following equation:

$$\text{Oil Absorption} = \frac{A \times 100}{B}$$

wherein A stands for the amount (g) of linseed oil added dropwise to the sample and B denotes the amount (g) of the sample.

According to this invention, the so prepared substantially spherical fixing magneto-sensitive particles (A) are dry-blended with flowability- and electric resistance-controlling fine particles (B) having a particle size smaller than 4 microns, especially smaller than 0.1 micron, and a volume resistivity not higher than $10^{12}$ Ω-cm, preferably not higher than $10^{10}$ Ω-cm.

As the flowability- and electric resistance-controlling fine particles (B), there can be employed, carbon black, inorganic fine particles which are non-conductive in themselves but are subjected to the electrically conductive treatment, and various metal powders.

As the carbon black having a particle size not larger than 3μ and a volume resistivity not higher than $10^{12}$ Ω-cm, there can be used, for example, furnace black for rubbers, channel black for cells or rubbers and channel black for pigments. Especially preferred carbon black includes conductive carbon black Corox-L manufactured by Degussa Co. and Vulcan XC-72R manufactured by Cabot, Inc.

Further, particles of metal oxides such as diiron trioxide, triion tetroxide and dinickel trioxide and ultrafine particles of metals such as iron, cobalt, copper, silver, gold, aluminum and tin can also be used as the particles (B). Moreover, inorganic substances such as silicon dioxide, activated clay, acid clay, kaolin, alumina powder and zeolite, which are non-electrolytically plated with such metals as gold, silver and copper, may be used as the flowability- and electric resistance-controlling fine particles (B) in this invention.

As the inorganic fine particles (carrier particles) there are preferably employed those having a good flowability and a capacity of absorbing or adsorbing therein a surface active agent, a dye and a conductive resin. For example, silicon dioxide, activated clay, acid clay, kaolin, alumina powder and zeolite are preferably employed. It is preferred that the particle size of such carrier particles be smaller than 1/10 of the particle size of the spherical particles (A), especially smaller than 4μ, especially preferably smaller than 0.1μ.

As suitable examples of silicon dioxide particles, there can be mentioned Aerosil 200, Aerosil R972, Silica D17 and Sipernat 17 manufactured by Nippon Aerosil K.K. Fine particles of acid clay, kaolin and zeolite can also be preferably used as the carrier particles.

A solvent suitable for absorbing or adsorbing a surface active agent, a conductive resin or a dye on such inorganic carrier particles is one capable of dissolving therein a treating agent such as mentioned above but incapable of dissolving therein the carrier particles. Moreover, the solvent is desired to have such a property that it volatilizes by drying and is not substantially left in the carrier particles after drying.

As such solvent, there can be mentioned, for example, lower alcohols such as methanol, ethanol and propanol, ketones such as acetone, ethers such as tetrahydrofuran and dioxane, amines such as morpholine and pyrrolidone, sulfoxides such as dimethylsulfoxides, aromatic hydrocarbons such as benzene, toluene and xylene, halogenated hydrocarbons such as chloroform, carbon tetrachloride, trichlene, perchlene and freon, esters such as ethyl acetate and amyl acetate, and water. These solvents may be used singly or in the form of a mixture of two or more of them.

A dye dissolved in such solvent is absorbed or adsorbed on the carrier particles. The kind of the dye is not particularly critical and substantially all of dyes can be used.

For example, direct dyes, basic dyes, acid dyes, mordant dyes, reactive dyes, acid mordant dyes, fluorescent dyes and oil-soluble dyes can be used. Specific examples that are used in this invention are Direct Black 51, Basic Blue 9, Acid Red 94, Bromophenol Blue, Mordant Black 7, Reactive Red 6, Disperse Red 17, Solvent Red 24, Fluorescent Blightening Agent 30 and the like.

Suitable examples of surface active agents and conductive resins (hereinafter referred to as "treating agents") are as follows:

A. Organic Conducting Agents:

(1) Cationic Conducting Agents:

(1-a) Amine Type Conducting Agents:

Primary, secondary and tertiary alkylamines, cycloalkylamines and alkanolamines, their acid addition salts with carboxylic acids, phosphoric acid or boric acid, and polyalkyleneimines, amideamines and polyamines and their complex metal salts.

(1-b) Imidazoline Type Conducting Agents:

1-Hydroxyethyl-2-alkylimidazolines and the like.

(1-c) Amine-Ethylene Oxide Adducts and Amine-Propylene Oxide Adducts:

Adducts of ethylene oxide, propylene oxide or other akylene oxide to mono- or di-alkanolamines, long-chain ($C_{12}$ to $C_{22}$) alkylamines or polyamines.

(1-d) Quaternary Ammonium Salts:

Quaternary ammonium salts represented by the following general formula:

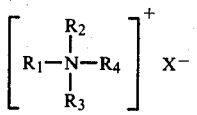

wherein $R_1$ to $R_4$, which may be the same or different, stand for an alkyl group with the proviso that at least 2 of $R_1$ to $R_4$ stand for a lower alkyl group and at least one of $R_1$ to $R_4$ stands for an alkyl group having at least 6 carbon atoms, preferably at least 8 carbon atoms, and $X^-$ denotes a halide ion, and quaternary ammonium salts represented by the following general formula:

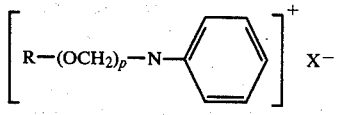

wherein R stands for an alkyl group having at least 12 carbon atoms, p is 0 or 1, and X stands for a halide ion.

(1-e) Other Cationic Conducting Agents:

Cationic polymers formed by quaternizing polymers of aminoalcohol esters of ethylenically unsaturated carboxylic acids (such as a quaternary ammonium type polymer of diethylaminoethyl methacrylate), acrylamide derivatives (such as a quaternary ammonium type polymer of N,N-diethylaminoethyl acrylamide), vinyl ether derivatives (such as a pyridium salt of polyvinyl-2-chloroethyl ether), nitrogen-containing vinyl derivatives (such as a product formed by quaternizing poly-2-vinylpyridine with p-toluenesulfonic acid), polyamine resins (such as polyethylene glycol polyamine), and polyvinylbenzyltrimethyl ammonium chloride.

(2) Anionic Conducting Agents:

(2-a) Sulfonic Acid Type Conducting Agents:

Alkylsulfonic acids, sulfated oils, and salts of higher alcohol sulfuric acid esters.

(2-c) Carboxylic Acid Type Conducting Agents:

Adipic acid and glutamic acid.

(2-c) Phosphoric Acid Derivative Conducting Agents:

Phosphonic acid, phosphinic acid, phosphite esters and phosphate ester salts.

(2-d) Other Anionic Conducting Agents:

Homopolymers and copolymers of ethylenically unsaturated carboxylic acids (such as polyacrylic acid and copolymers of maleic anhydride with comonomers such as styrene and vinyl acetate), and homopolymers and copolymers of sulfonic acid group-containing vinyl compounds (such as polyvinyltoluenesulfonic acid and polystyrenesulfonic acid).

(3) Non-Ionic Conducting Agents:

(3-a) Polyether Type Conducting Agents:

Polyethylene glycol and polypropylene glycol.

(3-b) Alkylphenol Adduct Type Conducting Agents:

Adducts of ethylene oxide or propylene oxide to alkylphenols.

(3-c) Alcohol Adduct Type Conducting Agents:

Adducts of ethylene oxide or propylene oxide to alcohols (such as a higher alcohol-ethylene oxide adduct).

(3-d) Ester Type Conducting Agents:

Butyl, amyl and glycerin esters of higher fatty acids such as adipic acid and stearic acid.

(3-e) Amide Type Conducting Agents:

Higher fatty acid amides, dialkyl amides, and adducts of ethylene oxide or propylene oxide to these amides.

(3-f) Polyhydric Alcohol Type Conducting Agents:

Ethylene gllycol, propylene glycol, glycerin, pentaerythritol and sorbitol.

(4) Amphoteric Conducting Agents:

Betain type conducting agents, imidazoline type conducting agents and aminosulfonic acid type conducting agents.

B. Inorganic Conducting Agents:

Alkaline earth metal halides such as magnesium chloride and calcium chloride, inorganic salts such as zinc chloride and sodium chloride, chromium complexes of the Werner type in which trivalent chromium is coordinated with a monobasic acid, and hydrolysis products such as chlorosilane and silicon tetrachloride.

Treating agents exemplified above may be used singly or in the form of a mixture of two or more of them.

A treating agent such as exemplified above is dissolved in a liquid medium substantially incapable of dissolving the carrier particles to be treated, so that the concentration of the treating agent is maintained at a suitable level, for example, 0.1 to 0.5% by weight. Then, the surface treatment of the carrier particles is performed by dipping the particles into the so formed solution of the treating agent or spraying the solution on the carrier particles.

The above-mentioned spherical fixing magneto-sensitive particles (A) are dry-blended with the so prepared flowability- and electric resistance-controlling fine particles (B) at a mixing weight ratio (A):(B) in the range of from 10000:1 to 50:1, preferably from 2000:1 to 100:1. When this mixing ratio (A)/(B) is smaller than 50/1, as illustrated in Comparative Example 2 given hereinafter, the adsorption or adhesion of the fine particles (B) onto the spherical particles (A) becomes insufficient and contamination of the background of the developed copy is often caused to occur. Further, the fixing property of the resulting developer tends to be degraded. If the above mixing ratio (A)/(B) is larger than 10000/1, as is shown in Comparative Example 1 given hereinafter, the flowability of the developer is reduced and the adaptability of the developer to the developing operation is degraded. Moreover, the electric resistance of the developer per se is increased and there can be only obtained copies having a low contrast and bleeding contours.

The test method and apparatus used for determining the volume resistivity with respect to the fixing electrosensitive particles (A), the flowability- and electric resistance-controlling fine particles (B) and dry blends of both the particles (A) and (B) will now be described.

Test Method

A sample of the particles (A) or the dry blend of the particles (A) and (B) is maintained in a region where a magnetic force (about 680 gauss) acts and it is kept under such conditions that a force other than gravity and magnetic force is not applied to the sample. In this state, the sample is contacted with electrodes and the electric resistance is determined according to a customary method. The spacing between the electrodes is correctly measured by using a micrometer. In this manner, the volume resistivity can be determined.

In case of a sample of the fine particles (B), a suitable amount of the sample is stationarily placed on the electrode surface. Other procedures are the same as described above.

The adopted test conditions are as follows:

Electrodes: made up of brass

Electrode thickness: 1 mm

Magnetic force: about 680 gauss on the surface

Electrode spacing: 1.5 mm

Applied voltage: 30 to 1,000 V

The developer of this invention can be advantageously applied to various electrostatic photographical processes. For example, the developer of this invention can be applied to a process disclosed in Japanese Patent Application Laid-Open Specification No. 4532/74.

Most preferably, the developer of this invention can be applied to a method for developing electrostatic latent images, proposed by us previously (Japanese Patent Application No. 88381/74); which comprises holding a finely divided solid developer on the surface of a developer-holding cylindrical member and applying the developer to the surface of an electrostatic latent image-holding member to thereby visualize the electrostatic latent image, the surface of the developer-holding member is caused to have rolling contact with the surface of the electrostatic latent image-holding member through the developer while moving both the surfaces at the substantially same speed, the surface of the developer-holding member is brought close to the electrostatic latent image-holding member so that a reservoir zone for the developer is formed at least upstream of the position of said rolling contact, and wherein a physical turbulence is given to particles of the developer in said reservoir zone for the developer.

The present invention will now be described in detail by reference to the following Examples that by no means limit the scope of the invention.

EXAMPLE 1

In 1000 ml of acetone were dissolved and dispersed 35 g of an epoxy resin (Epiclon 4050 manufactured by Dai Nippon Ink), 60 g of triiron tetroxide (Iron Black B-6 manufactured by Toyo Shikiso) and 5 g of carbon black (Corax-L manufactured by Degussa Co.) by means of an attritor. The resulting slurry was sprayed in a dry current maintained at 130° C. by using a two-fluid type injection nozzle and thus dried. Then, sieving was conducted to collect spherical particles having a particle size of 2 to 44μ. The particles were found to have an oil absorption of 29.8.

The particles were dry-blended with 0.1% by weight of carbon black (Corax-L) by the V-type mixer to form a developer.

The copying operation was carried out in a copying machine (Model 700D manufactured by Mita Industrial Co.) by using the so prepared developer. A clear image having a high contrast and being free of contamination of the background was obtained. The flowability of the developer in the developing zone of the copying machine was very good.

The volume resistivity of the developer was $5.9\times10^9$ Ω-cm (applied voltage of 400 V/cm).

EXAMPLE 2

Spherical particles having a particle size of 2 to 44μ were prepared in the same manner as in Example 1.

The particles were dry-blended with 0.5% by weight of carbon black (Corax-L) to form a developer. The copying operation was carried out in a copying machine (Model 700D) by using the so prepared developer. An image having a high contrast but being free of contamination of the background was obtained. The flowability of the developer in the developing zone of the copying machine was very good.

The volume resistivity of the developer was $8.5\times10^8$ Ω-cm (applied voltage of 400 V/cm).

Comparative Example 1

Spherical particles having a particle size of 2 to 44μ were prepared in the same manner as in Example 1.

The particles were dry-blended with 0.005% by weight of carbon black (Corax-L) to form a developer. The copying operation was carried out in a copying machine (Model 700D) by using the so prepared developer. An image having a low contrast in which an edge effect and bleeding of contours were observed was obtained. If was found that the flowability of the developer in the developing zone was very bad. The volume resistivity of the developer was $3.3\times10^{14}$ Ω-cm (applied voltage of 400 V/cm).

COMPARATIVE EXAMPLE 2

Spherical particles having a particle size of 2 to 44μ were prepared in the same manner as in Example 1.

The particles were dry-blended with 5% by weight of carbon black (Corax-L) to form a developer. The copying operation was carried out in a copying machine (Model 700D) by using the so prepared developer. The background of the resulting image was extremely contaminated with excessive carbon black which did not adhere to the spherical particles but were present in the floating state.

The volume resistivity of the developer could not be measured according to the above-mentioned method and apparatus because of the leaking phenomenon.

COMPARATIVE EXAMPLE 3

A mixture of 100 g of an epoxy resin, 600 g of triiron teroxide, 3 g of an azine type dye and 2 g of carbon black was dispersed in 5,000 ml of acetone, and by conducting the spray-drying and sieving in the same manner as in Example 1, particles having a size of 2 to 44μ were prepared. The particles were not spherical but amorphous. The copying operation was carried out in a copying machine (700D) by using the particles as a developer. In the resulting copied image, contamination of the background was conspicuous and contours were bleeding.

The flowability of the developer in the developing zone of the copying machine was very bad. The volume resistivity of the developer was $1.3\times10^{10}$ Ω-cm (applied voltage of 400 V/cm).

COMPARATIVE EXAMPLE 4

A mixture of 4 parts by weight of an epoxy resin and 6 parts by weight of triiron tetroxide was sufficiently kneaded and milled by two hot rolls. The kneaded mixture was pulverized and sieved to obtain particles having a particle size of 2 to 44μ. These particles had a pseudo-cubic form including sharp sides. These particles were made spherical in a hot air current maintained at 530° C. to obtain particles having lustrous particles. The oil absorption of the particles was 17.6.

The so prepared particles were dry-blended with 0.5% by weight of carbon black (Corax-L) to form a developer.

The copying operation was carried out in a copying machine (Model 700D) by using the so prepared developer. The background of the obtained image was extremely contaminated with carbon black which did not adhere sufficiently to the particles.

The volume resistivity of the developer was $1.0\times10^9$ Ω-cm (applied voltage of 400 V/cm).

Properties of developers obtained in the foregoing Examples 1 and 2 and Comparative Examples 1 to 4 and images obtained by using these developers were examined and evaluated in the following manners. Obtained results are shown in Table 1.

Bleeding

By the term "bleeding" is meant a phenomenon in which sharp portions of figures or patterns are seen thick or peripheral portions are obscure. The bleeding was evaluated according to the following scale:

O: no bleeding
Δ: slight bleeding
X: conspicuous bleeding

Fog

By the term "fog" is meant a phenomenon in which the background is contaminated with specks or dots. The fog is evaluated according to the following scale:

O: no fog
Δ: slight fog
X: extreme fog

Edge Effect

By the term "edge effect" is meant a phenomenon in which central portions of figures or the like are not printed sufficiently but left in blank, but peripheral portions are printed densely. The edge effect is evaluated according to the following scale:

O: no edge effect
Δ: peripheral portions printed slightly densely
X: central portions of figures or the like left completely unprinted in blank

Image Density

By the term "image density" is meant a reflection density of the image. The image density is evaluated according to the following scale:

O: reflection density higher than 1.5
Δ: reflection density of 1 to 1.5
X: reflection density lower than 1

Fixing Property

By the term "fixing property" is meant the adhesion strength of the developer to the copy. The fixing property is evaluated according to the following scale:

O: the developer was not isolated by strong rubbing with a finger
Δ: when the image is rubbed with a finger, the developer is slightly isolated and the background is contaminated
X: when the image is rubbed with a finger, the developer is completely isolated

Flowability

The flowability is evaluated based on the flow of the developer on a developing roller according to the following scale:

O: the developer flows smoothly without agglomeration
Δ: small agglomerates are formed and the flowing is slightly bad
X: a number of large agglomerates are formed and the developer does not flow smoothly

Scattering

The scattering tendency of the developer is evaluated according to the following scale:

O: no scattering of the developer and no contamination of the developing zone or the background with the developer
Δ: slight scattering
X: conspicuous scattering

TABLE I

| | | | Printed Image | | | | | Developer | |
|---|---|---|---|---|---|---|---|---|---|
| Sample | Shape of Particles | Volume Resistivity (Ω-cm) | Bleeding | Fog | Edge Effect | Density | Fixing Property | Flowability | Scattering |
| Example 1 | spherical | $5.9\times10^9$ | O | O | O | O | O | O | O |
| Example 2 | spherical | $8.5\times10^8$ | O | O | O | O | Δ | O | O |
| Comparative Example 1 | spherical | $3.3\times10^{14}$ | Δ | O | Δ | Δ | O | Δ | O |
| Comparative Example 2 | spherical | leaking | O | X | O | O | Δ | Δ | Δ |
| Comparative Example 3 | amorphous | $1.3\times10^{10}$ | X | X | O | Δ | X | X | Δ |
| Comparative Example 4 | spherical | $1.0\times10^9$ | O | X | O | O | Δ | O | O |

Examples of production of the fixing magneto-sensitive particles (A) will now be described.

EXAMPLE A

A dispersion of 50 g of an epoxy resin (Epikote 1004 manufactured by Shell Chemical) and 50 g of triiron tetroxide in 1 l of acetone was sprayed in a dry air current maintained at 130° C. and thus dried. The resulting particles were sieved to collect particles having a size of 2 to 44μ. The volume resistivity of the so prepared particles was higher than $1\times10^{14}$ Ω-cm.

EXAMPLE B

In 1 l of a 1:1 mixed solvent of acetone and toluene were dissolved and idspersed 35 g of an epoxy resin (Epikote 1004), 60 g of triiron tetroxide and 5 g of carbon black, and the dispersion was spray-dried in a dry air current maintained at 130° C. The resulting particles were sieved to collect particles having a size of 2 to 44μ. The volume resistivity of the particles was $3.7\times10^{13}$ Ω-cm.

EXAMPLE C

In 1 l of hot toluene were dissolved and dispersed 27 g of a petroleum resin (Hi-rez P-100LM manufactured by Mitsui Sekiyu K.K.), 38 g of polypropylene (Biscol 550-P manufactured by Sanyo Kasei K.K.) and 35 g of triiron tetroxide, and the dispersion was spray-dried in a dry air current maintained at 150° C. The resulting particles were sieved to collect particles having a size of 2 to 44μ. The volume resistivity of the particles was higher than $1\times10^{14}$ Ω-cm.

EXAMPLE D

In 1 l of hot toluene were dissolved and dispersed 26 g of a saturated alicyclic resin (Arkon P-115 manufactured by Arakawa Rinsan Kagaku K.K.), 11 g of an ethylene-vinyl acetate copolymer (Evaflex 420 manufactured by Mitsui Polychemical K.K.), 55 g of triiron tetroxide and 8 g of carbon black, and the dispersion was spray-dried in a dry air current maintained at 150° C. The resulting particles were sieved to collect particles having a size of 2 to 44μ. The volume resistivity of the particles was $2.1\times10^{13}$ Ω-cm.

Production of the flowability- and electric resistance-controlling fine particles (B) will now be described.

EXAMPLE E

In 20 ml of water was completely dissolved 0.3 g of Direct Black 51 (C.I. 27720), and 10 g of finely divided silica (Aerosil A200 manufactured by Nippon Aerosil K.K.) was added to the dye solution and sufficiently dispersed in the solution by a ultrasonic vibrator to thereby make the dye uniformly adsorbed on the surface of the finely divided silica. The solvent was evaporated and the residue was dried. Then, the dye-adsorbed silica was treated in a ball mill to reduce the particle size. The volume resistivity of the so obtained particles was $3.0\times10^{7}$ Ω-cm.

EXAMPLE F

In 10 ml of water was completely dissolved 1 ml of an non-ionic type activator solution (Anon BF manufactured by Nippon Oils and Fats Co. Ltd.) and 10 of finely divided silica was added to the activator solution and sufficiently dispersed therein. The solvent was evaporated and the residue was dried to thereby obtain silica particles having the activator uniformly adsorbed thereon. The volume resistivity of the so treated silica particles was $2.7\times10^{10}$ Ω-cm.

EXAMPLE G

In 20 ml of an aqueous solution of sodium hydroxide was completely dissolved 0.5 g of Sulfur Black 2 (C.I. 53195), and 10 g of activated clay having a size smaller than 5μ was sufficiently dispersed in the dye solution to thereby make the dye uniformly adsorbed on the surface of the activated clay. The solvent was evaporated, and the residue was dried and pulverized to obtain fine particles having a volume resistivity of $4.5\times10^{9}$ Ω-cm.

EXAMPLE H

To a solution of 0.5 g of Acid Red 94 (C.I. 45440) in 20 ml of methanol was added 10 g of finely divided silica (Aerosil A200), and the finely divided silica was sufficiently dispersed in the dye solution to make the dye uniformly adsorbed on the surface of the finely divided silica. The dye-adsorbed silica was dried to obtain fine particles having a volume resistivity of $8.9\times10^{9}$ Ω-cm.

EXAMPLE I

In 100 ml of methanol was dissolved 100 g of a conductive resin (BR-013 manufactured by Toyo Ink K.K.; solid content=45% by weight), and 100 g of finely divided silica (Aerosil A200) was incorporated and dispersed in the solution. The dye-adsorbed silica was dried to obtain fine particles having a volume resistivity of $2.3\times10^{8}$ Ω-cm.

EXAMPLE J

In a solution of 0.5 g of Bromophenol Blue in 20 ml of an aqueous solution of sodium hydroxide was incorporated and dispersed 10 g of finely divided silica (Aerosil A200) to make the dye sufficiently and uniformly adsorbed on the silica. The dye-adsorbed silica was dried to obtain fine particles having a volume resistivity of $7.4\times10^{7}$ Ω-cm.

EXAMPLE K

Carbon black (50 g) (Mitsubishi Carbon Black #30 manufactured by Mitsubishi Kasei K.K.) was treated in a ball mill having a capacity of 1 liter to disentangle agglomerates. The volume resistivity of the so treated fine particles of carbon black could not be measured because of the leaking phenomenon.

EXAMPLE L

Carbon black (50 g) (Corax-L) was treated in a ball mill having a capacity of 1 liter to disentangle agglomerates. The volume resistivity of the fine particles of carbon black could not be measured because of the leaking phenomenon.

EXAMPLE M

In an aqueous solution containing a surface active agent, 10 g of finely divided silica having a size not exceeding 100 mμ was washed under ultrasonic vibrations to effect degreasing, and then, the silica particles were sufficiently washed with water, and they were subjected to non-electrolytic plating in the following manner.

The silica particles were immersed in a solution of 10 ml of a pre-treating liquid for non-electrolytic plating (Sensitizer manufactured by Nippon Kanizen K.K.) in 90 ml of water for about 5 minutes to activate the silica particles. Then, the activated silica were recovered by filtration. Then, the particles were treated in a solution of 20 ml of a pre-treating liquid for non-electrolytic plating (Activator manufactured by Nippon Kanizen K.K.) in 80 ml of water for 3 to 5 minutes to effect the activating treatment. Then, the activated particles were recovered by filtration, and they were dipped in a solution of 40 ml of a non-electrolytic nickel-plating liquid (Blue-Sumer manufactured by Nippon Kanizen K.K.) in 160 ml of water for 5 to 10 minutes to deposit metallic nickel on the surfaces of the silica particles. The plated particles were collected by filtration, washed with water and dried. The volume resistivity of the so plated fine silica particles was $5.3\times10^4$ Ω-cm.

EXAMPLE N

In the same manner as described in Example M, 10 g of fine particles of activated clay having a particle size smaller than 100 mμ were pre-treated. Then, they were dipped in a chemical copper-plating liquid (manufactured by Okuno Seiyaku Kogyo K.K.) for 5 to 10 minutes under agitation to deposit non-electrolytically copper on the surfaces of the activated silica particles. The volume resistivity of the resulting copper-plated particles was $6.5\times10^4$ Ω-cm.

EXAMPLE O

In the same manner as described in Example M, 20 g of finely divided triiron tetroxide having a particle size smaller than 1μ was pre-treated. Then, the pre-treated triiron tetroxide was dipped in a chemical silver-plating liquid (disclosed in Handbook of Chemistry compiled by Japanese Chemical Society) for 2 to 5 minutes under agitation to deposit non-electrolytically silver on the surface of the finely divided triiron tetroxide. The volume resistivity of the so plated triiron tetroxide was $2.3\times10^4$ Ω-cm.

EXAMPLE P

Reduced copper powder (manufactured by Fukida Kinzoku Hakufun K.K.) was classified by a sieve to collect fine particles of copper having a size smaller than 4μ. The volume resistivity of the copper powder could not be measured because of the leaking phenomenon.

EXAMPLE Q

Silver powder was classified by a sieve to collect fine particles having a size smaller than 4μ. The volume resistivity of the silver powder could not be measured because of the leaking phenomenon.

EXAMPLE R

Iron powder (manufactured by Nippon Teppun K.K.) was classified by a sieve to collect fine particles having a size smaller than 4μ. The volume resistivity of the iron powder could not be measured because of the leaking phenomenon.

Characteristic features of developers prepared by dry-blending the foregoing fixing magneto-sensitive particles (A) with the above-mentioned flowability- and electric resistance-controlling fine particles (B) at the (A):(B) mixing weight ratios in the range of from 10000:1 to 50:1 will now be described by reference to the following Examples.

EXAMPLE 3

A developer was prepared by dry-blending 100 parts by weight of the particles obtained in Example A sufficiently with 0.1 part by weight of the fine particles obtained in Example E by using a V-type mixer. The copying operation was carried out on white copying paper in a copying machine of the heated roll fixing type (Model 700D manufactured by Mita Industrial Co.) by using this developer. A clear copied image of a sheer black color was formed. The developer prepared in this Example had a better flowability than that of the particles obtained in Example A, and the volume resistivity of the developer was reduced to $8.3\times10^{11}$ Ω-cm though the volume resistivity of the particles obtained in Example A was higher than $10^{14}$ Ω-cm.

EXAMPLE 4

In a mill filled with glass beads, 100 parts by weight of the particles obtained in Example B were dry-blended sufficiently with 0.1 part by weight of the fine particles obtained in Example F to form a developer. The copying operation was carried out in a copying machine (Model 700D) by using the so prepared developer. A clear copied image of a sheer black color being free of contamination in the background was obtained. The flowability of the developer was better than the flowability of the particles obtained in Example B, and the volume resisitivity of the developer was as low as $5.0\times10^{10}$ Ω-cm, though the volume resistivity of the particles obtained in Example B $3.7\times10^{13}$ Ω-cm.

EXAMPLE 5

In a sand mill, 100 parts by weight of the particles obtained in Example C were dry-blended sufficiently with 0.05 part by weight of the fine particles obtained in Example G to form a developer. The copying operation was carried out in a copying machine of the pressure fixing type (Mita Copystar 350D manufactured by Mita Industrial Co.) by using the so prepared developer. A copy having an image of a sheer black color free of contamination in the background was obtained. The developer had a good flowability, and the volume resistivity of the developer was as low as $3.1\times10^{11}$ Ω-cm, though the volume resistivity of the particles obtained in Example C was higher than $10^{14}$ Ω-cm.

EXAMPLE 6

By means of a V-type mixer, 100 parts by weight of the particles obtained in Example D were dry-blended sufficiently with 0.04 part by weight of the fine particles obtained in Example H to form a developer. The copying operation was carried out in a copying machine (Mita Copystar 350D) by using the so prepared developer. A print having an excellent constant and being free of fog was obtained. The developer was excellent in the flowability and agglomeration was not observed at all. The volume resistivity of the developer was as low as $4.0\times10^{10}$ Ω-cm, though the volume resistivity of the particles obtained in Example D was $2.1\times10^{13}$ Ω-cm.

EXAMPLE 7

In a sand mill, 100 parts by weight of the particles obtained in Example A were dry-blended sufficiently with 0.05 part by weight of the fine particles obtained in Example J to obtain a developer. The copying operation was carried out on white copying paper in a copying machine (Model 700D) by using the so prepared developer. A clear black image having high density and contrast and free of fog was obtained. The volume resistivity of the developer was $7.3\times10^9$ Ω-cm.

EXAMPLE 8

By means of a V-type mixer, 100 parts by weight of the particles obtained in Example B were dry-blended sufficiently with 0.02 part by weight of the fine particles obtained in Example L to form a developer. The copying operation was carried on white copying paper in a copying machine (Model 700D) by using the so prepared developer. A clear copied image having a high contrast and free of fog was obtained. No agglomeration was observed in the developer, and the volume resistivity of the developer was as low as $7.3\times10^8$ Ω-cm.

EXAMPLE 9

By means of a V-type mixer, 100 parts by weight of the particles obtained in Example C were dry-blended sufficiently with 0.3 part by weight of the fine particles obtained in Example I to form a developer. The copying operation was carried out on white copying paper in a copying machine (Mita Copystar 350D) by using the so prepared developer. A black image having a high contrast and free of fog was obtained. The volume resistivity of the developer was as low as $6.5\times10^9$ Ω-cm.

EXAMPLE 10

By means of a V-type mixer, 100 parts by weight of the particles obtained in Example D were dry-blended with 0.1 part of the fine particles obtained in Example K to form a developer. The copying operation was carried out in a copying machine (Mita Copystar 350D) by using the so prepared developer. A clear print free of contamination in the background was obtained. The developer had a very good flowability and the volume resistivity of the developer was $4.4\times10^9$ Ω-cm.

EXAMPLE 11

By means of a V-type mixer, 100 parts by weight of the particles obtained in Example A were dry-blended with 0.3 part by weight of the fine particles obtained in Example M to form a developer. The copying operation was carried out in a copying machine (Model 700D) by using the so prepared developer. A clear print was obtained. The volume resistivity of the developer was $6.9\times10^{10}$ Ω-cm.

EXAMPLE 12

A developer was prepared by dry-blending 100 parts by weight of the particles obtained in Example B with 0.05 part by weight of the fine particles obtained in Example N. The copying operation was carried out in a copying machine (Model 700D) by using the so prepared developer. A print free of bleeding but having a high density was obtained. The developer had a good flowability, and the volume resistivity of the developer was $1.4\times10^9$ Ω-cm.

EXAMPLE 13

A developer was prepared by dry-blending 100 parts by weight of the particles obtained in Example C with 1 part by weight of the fine particles obtained in Example O to form a developer. The copying operation was carried out in a copying machine (Mita Copystar 350D) by using the so prepared developer. A print having a high density and an excellent fixing property was obtained. The volume resistivity of the developer was $9.0\times10^{10}$ Ω-cm.

EXAMPLE 14

A developer was prepared by dry-blending 100 parts by weight of the particles obtained in Example D with 1.0 part by weight of the fine particles obtained in Example P to form a developer. The copying operation was carried out in a copying machine (Mita Copystar 350D) by using the so prepared developer. A print being free of contamination in the background and having a high density and an excellent fixing property was obtained. The volume resistivity of the developer was $7.7\times10^9$ Ω-cm.

EXAMPLE 15

A developer was prepared by dry-blending 100 parts by weight of the particles obtained in Example A with 1.5 parts by weight of the fine particles obtained in Example Q to form a developer. The copying operation was carried out in a copying machine (Model 700D) by using the so prepared developer. A clear print having a high density was obtained. The developer had a good flowability and the volume resistivity of the developer was $5.1\times10^9$ Ω-cm.

EXAMPLE 16

A developer was prepared by dry-blending 100 parts by weight of the particles obtained in Example C with 2.0 parts by weight of the fine particles obtained in Example R to form a developer. The copying operation was carried out in a copying machine (Mita Copystar 350D) by using the so prepared developer. A clear print free of bleeding was obtained. The volume resistivity of the developer was $4.6\times10^{10}$ Ω-cm.

What we claim is:

1. A developer for electrostatic photography consisting essentially of a dry blend of (A) substantially spherical fixing magneto-sensitive particles of a composition consisting essentially of 40 to 60% by weight of a fine powder of a magnetic material, 30 to 60% by weight of a binder medium composed of a resin, rubber or wax having an adhesiveness under application of heat or pressure and 1 to 10% by weight of carbon black, said fine powder of the magnetic material being dispersed in said binder medium, said substantially spherical particles (A) having on the surfaces thereof fine convexities and concavities formed by spraying a dispersion of said composition into a drying atmosphere and having a particle size of 2 to 44 microns, and (B) flowability- and electric resistance-controlling fine particles having a volume resistivity not higher than $10^{12}$ Ω-cm and a particle size not larger than 1/10 of the particle size of the substantially spherical particles (A), said substantially spherical particles (A) being dry-blended with said fine particles (B) at a mixing weight ratio (A):(B) in the range of from 2000:1 to 100:1, said fine particles (B) being distributed predominantly on and adhering to the surface portion of said spherical particles (A) without being embedded by the dry blending.

2. A developer as set forth in claim 1 wherein the fine powder of the magnetic material is a powder of triiron tetroxide having a particle size smaller than 500 mμ.

3. A developer as set forth in claim 1 wherein the resin is an epoxy resin.

4. A developer as set forth in claim 1 wherein the substantially spherical fixing magneto-sensitive particles (A) have an oil absorption of 25 to 40.

5. A developer as set forth in claim 1 wherein the substantially spherical fixing magneto-sensitive particles (A) are formed by dissolving a binder medium composed of a resin, rubber or wax in an easily volatile organic solvent so that the binder medium concentration is not higher than 30% by weight, dispersing a fine powder of a magnetic material in the solution and spraying the resulting slurry into a drying atmosphere to thereby effect drying and granulation.

6. A developer as set forth in claim 1 wherein the flowability- and electric resistance-controlling fine particles are composed of carbon black.

* * * * *